US006214504B1

(12) United States Patent
Esteghamatian et al.

(10) Patent No.: US 6,214,504 B1
(45) Date of Patent: Apr. 10, 2001

(54) PHOTOCONDUCTIVE IMAGING MEMBERS

(75) Inventors: Mohammad Esteghamatian, Burlington; Ah-Mee Hor; James M. Duff, both of Mississauga; C. Geoffrey Allen, Waterdown; Dasarao K. Murti, Mississauga, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/604,243

(22) Filed: Jun. 27, 2000

(51) Int. Cl.[7] ..... G03G 5/06

(52) U.S. Cl. ..... 430/58.65; 430/58.8; 430/59.1; 430/78

(58) Field of Search ..... 430/58.65, 58.8, 430/59.1, 78

(56) References Cited

U.S. PATENT DOCUMENTS

| | | | | |
|---|---|---|---|---|
| 3,121,006 | | 2/1964 | Middleton et al. | 96/1 |
| 4,265,990 | | 5/1981 | Stolka et al. | 430/59 |
| 4,464,450 | | 8/1984 | Teuscher | 430/59 |
| 4,587,189 | | 5/1986 | Hor et al. | 430/59 |
| 4,921,773 | | 5/1990 | Melnyk et al. | 430/132 |
| 5,473,064 | | 12/1995 | Mayo et al. | 540/141 |
| 5,493,016 | | 2/1996 | Burt et al. | 540/139 |
| 5,645,965 | | 7/1997 | Duff et al. | 430/59 |
| 5,683,842 | | 11/1997 | Duff et al. | 430/59 |
| 5,756,245 | | 5/1998 | Esteghamatian et al. | 430/59 |
| 6,051,351 | * | 4/2000 | Hsiao et al. | 430/58.8 |

* cited by examiner

*Primary Examiner*—John Goodrow
(74) *Attorney, Agent, or Firm*—E. O. Palazzo

(57) ABSTRACT

A photoconductive imaging member containing a photogenerator layer comprised of a mixture of bis (methylbenzimidazo)perinone, optionally an (alkylimido) perylene, such as (n-pentylimido)perylene or mixtures of (n-pentylimido)perylene, bisbenzimidazo(2,1-a-1',2'-b) anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and a charge transport layer.

36 Claims, No Drawings

PHOTOCONDUCTIVE IMAGING MEMBERS

COPENDING APPLICATIONS AND PATENTS

Disclosed in U.S. Pat. No. 5,645,965, the disclosure of which is totally incorporated herein by reference, are photoconductive imaging members with perylenes and a number of charge transports, such as amines. The appropriate components and processes of this patent, such as a number of the perylenes like BZP and charge transports, may be selected for the imaging members of the present invention.

Illustrated in U.S. Pat. No. 5,645,965 are photoconductive imaging members containing symmetrical perylene bisimide dimers, and illustrated in U.S. Ser. No. 165,595, are photoconductive imaging members with certain perylene mixtures.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably a mixture of bisbenzimidazo (2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

In U.S. Pat. No. 5,756,245, the disclosure of which is totally incorporated herein by reference, there is illustrated a photoconductive imaging member comprised of a hydroxygallium phthalocyanine photogenerator layer, a charge transport layer, a barrier layer, a photogenerator layer comprised of BZP that is a mixture of bisbenzimidazo(2,1-a1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, and thereover a charge transport layer. BZP as a photogenerating pigment is illustrated, for example, in U.S. Pat. No. 5,683,842, the disclosure of which is totally incorporated herein by reference.

BACKGROUND OF THE INVENTION

This invention is generally directed to imaging members, and more specifically, the present invention is directed to imaging members containing BZP doped with perinones, perylenes, or mixtures thereof, BZP being disclosed in some of the above patents and in U.S. Pat. No. 4,587,189, the disclosure of which is totally incorporated herein by reference, and a charge transport layer. The imaging members of the present invention in embodiments exhibit excellent cyclic stability, independent layer discharge, and substantially no adverse changes in performance over extended time periods. The aforementioned photoresponsive, or photoconductive imaging members can be negatively charged when the photogenerating layer is situated between the hole transport layer and the substrate. Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein negatively charged or positively charged images are rendered visible with toner compositions of an appropriate charge polarity. The imaging members as indicated herein are in embodiments sensitive in the wavelength region of, for example, from about 550 to about 900 nanometers, and in particular, from about 700 to about 850 nanometers, thus diode lasers can be selected as the light source. Moreover, the imaging members of this invention are preferably useful in color xerographic applications where several color printings can be achieved in a single pass.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Photoresponsive imaging members with BZP alone, and phydroxygallium alone as a photogenerator pigment are known. These photoresponsive imaging members are usually comprised of a single generator and a single transport layer, and they can be selected for xerographic printing processes to perform one pass/one color printing, and multiple color printing requires repeating the process several times depending on the number of colors selected. Also, in the known trilevel xerographic process, conventional photoresponsive imaging members are used in one pass/two color printing processes. The imaging member is selectively discharged with a single laser source to create three potential levels and later toned to create two color printing processes.

The use of certain perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene, pigment photogenerating component. Both of the aforementioned patents disclose an aryl amine component as a hole transport layer.

The disclosures of all of the aforementioned publications, laid open applications, copending applications and patents are totally incorporated herein by reference.

SUMMARY OF THE INVENTION

It is an feature of the present invention to provide imaging members thereof with many of the advantages illustrated herein.

Another feature of the present invention relates to the provision of improved layered photoresponsive imaging members with photosensitivity to near infrared radiations.

It is yet another feature of the present invention to provide improved layered photoresponsive imaging members with a sensitivity to visible light, and which members possess improved electrical properties, such as excellent, and in embodiments increased photosensitivity, lower dark decay, increased photoreceptor lifetime without change in electrical properties and reduced sensitivity to changes in environmental conditions, such as temperature and humidity and improved coating characteristics, especially for BZP mixtures, and wherein the charge transport molecules do not diffuse, or there is minimum diffusion thereof into the BZP layer, and wherein the dopant or dopants can function as surface sensitizers for BZP thereby enhancing charge generation in the photogenerating layer.

Moreover, another feature of the present invention relates to the provision of layered photoresponsive imaging members with improved, for example from about 10 to about 25 percent improvement, sensitivity to light of a wavelength of from about 500 to about 800 nanometers.

In a further feature of the present invention there are provided imaging members containing a second photogenerating pigment of, for example, Type V hydroxygallium phthalocyanine, especially with XRPD peaks at, for example, Bragg angles (2theta±0.20°) of 7.4, 9.8, 12.4, 16.2, 17.6, 18.4, 21.9, 23.9, 25.0, 28.1, with the most intense peak being at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements.

In still a further feature of the present invention there are provided single tier or multilayered two-tier photoresponsive, or photoconductive imaging members which can be selected for imaging processes including color xerography, such as xerocolography, and three color printing by selectively discharging the two-tier imaging member wherein, for example, three different surface potentials can be obtained after exposure to light, that is for example zero voltage when both tiers are discharged; partial voltage when one tier is discharged, or full voltage when neither tier is discharged.

Aspects of the present invention relate to a photoconductive imaging member comprised of a photogenerator layer comprised of bis(methylbenzimidazo)perinone, or (n-pentylimido)perylene, bisbenzimidazo (2,1-a-1',2'-b) anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and a charge transport layer; a photoconductive imaging member comprised of a supporting substrate, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, and a charge. transport layer, and wherein the photogenerating layer further contains bis (methylbenzimidazo)perinone or (n-pentylimido)perylene; a photoconductive imaging member wherein the bis (methylbenzimidazo)perinone, or the (n-pentylimido) perylene is present in an amount of from about 1 to about 50 weight percent; a photoconductive imaging member wherein the bis(methylbenzimidazo)perinone, or the (n-pentylimido)perylene is present in an amount of from about 1 to about 25 weight percent; a photoconductive imaging member wherein a mixture is present containing from about 75 to about 100 weight percent of bis (methylbenzimidazo)perinone, and from about zero (0) to about 25 weight percent of (n-pentylimido)perylene, and wherein the total of the two components in the mixture is about 100 percent; a photoconductive imaging member wherein about 1 weight percent of (n-pentylimido)perylenes is present; a photoconductive imaging member wherein a mixture of isomers of (n-pentylimido)perylenes or bismethyl benzimidazo)perinone is present; a photoconductive imaging member wherein the photogenerator layer is situated between the substrate and the charge transport layer; a photoconductive imaging member wherein the supporting substrate is comprised of a conductive substrate comprised of a metal; a photoconductive imaging member wherein the substrate is a conductive substrate of aluminum, aluminized polyethylene terephthalate (MYLAR®), or titanized polyethyl terephthalate wherein the MYLAR® is of the formula

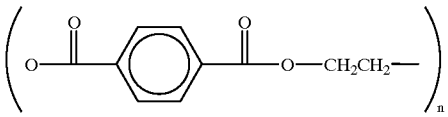

wherein n represents the number of segments; a photoconductive imaging member wherein the photogenerator layer has a thickness of from about 0.05 to about 10 microns; a photoconductive imaging member wherein the transport layer has a thickness of from about 5 to about 75 microns; a photoconductive imaging member wherein the photogenerating layer is dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layers comprise aryl amine molecules; a photoconductive imaging member wherein the aryl amines are of the formula

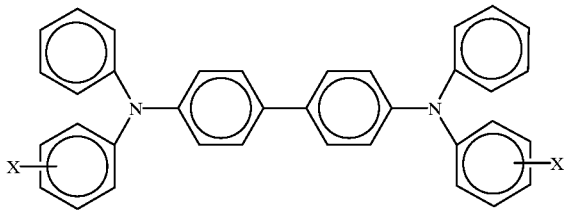

wherein X is selected from the group consisting of alkyl and halogen; a photoconductive imaging member wherein alkyl contains from about 1 to about 10 carbon atoms; a photoconductive imaging member wherein the aryl amines are molecules comprised of N,N'-diphenyl-N,N-bis(3-methyl phenyl) -1,1'-biphenyl-4,4'-diamine; a photoconductive imaging member further containing on the substrate a barrier layer of a thickness of from about 0.1 to about 3 microns; a photoconductive imaging member wherein the barrier layer is a polyester; a method of imaging which comprises generating an electrostatic latent image on the imaging member of the present invention, developing the latent image, and optionally transferring the developed electrostatic image to a suitable substrate; a method wherein the member is exposed to wavelengths of from about 680 to about 830 nanometers, respectively; a two-tier photoconductive imaging member comprised in the following sequence of a supporting substrate, a first hydroxygallium phthalocyanine photogenerator layer which absorbs light of a wavelength of from about 550 to about 950 nanometers, a first charge transport layer, a barrier layer, a second photogenerator layer comprised of a mixture of bis(methylbenzimidazo)perinone or (n-pentylimido)perylene, and bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione (BZP), which absorbs light of a wavelength of from about 500 to about 800 nanometers, and thereover a second charge transport layer; a photoconductive imaging member wherein a mixture of the bis (alkylbenzimidazo)perinone and the (alkylimido)perylene is present; a process which comprises adding to a photoconductive imaging member containing (BZP) bisbenzimidazo (2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, bis(alkyl benzimidazo)perinone, (alkylimido)perylene, or mixtures of (alkylimido)perylenes; a process wherein the perinone is bis(methyl benzimidazo)perinone and the alkyl perylene is (n-pentylimido)perylene; an imaging or printing apparatus containing the imaging member of the present invention; a photoconductive imaging member comprised of a photogenerator layer comprised of bis(alkylbenzimidazo)perinone, bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f')diisoquinoline-10,21-dione, and a charge transport layer; a photoconductive imaging member comprised of a photogenerator layer comprised of (alkylimido)perylene, bisbenzimidazo(2,1-a-1',2'-b)anthra (2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and a charge transport layer; a photoconductive imaging member wherein the perinone is a dopant; a photoconductive imaging member wherein the perylene is a dopant; a photoconductive imaging member wherein the dopant is present in an amount of from about 1 to about 7 weight percent; a photoconductive imaging member wherein the dopant is present in an amount of from about 1 to about 7 weight percent; a photoconductive imaging member wherein the perylene is comprised of a mixture of perylenes; a photoconductive imaging member wherein the perylene is of the formula, or mixtures thereof (a)

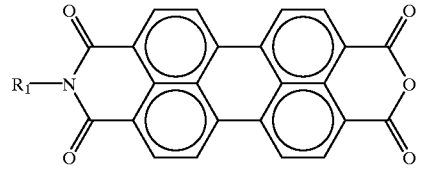

(b)

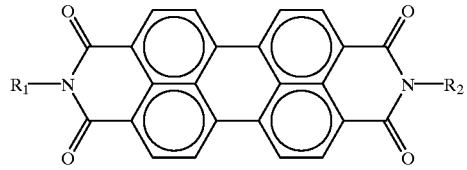

wherein $R_1$ to $R_8$ are independently hydrogen, alkyl, alkoxy, aryl, or aryloxy; a photoconductive imaging member wherein the perinone is of the formula, or mixtures thereof

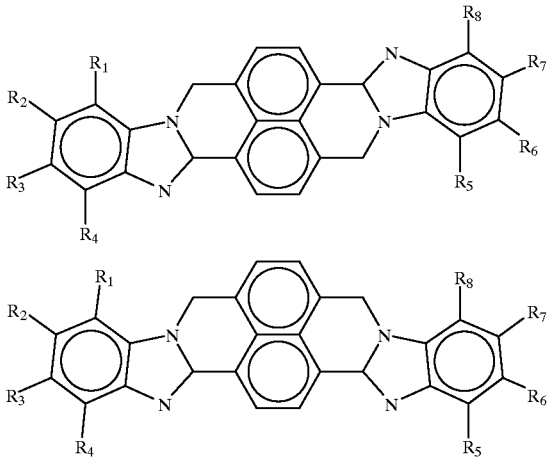

wherein $R_1$ and $R_2$ are independently alkyl; a photoconductive imaging member comprised of a supporting substrate, a barrier layer, an adhesive layer, a photogenerating layer of BZP perylene, which is preferably comprised of a mixture of bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f')diisoquinoline-10,21-dione, reference U.S. Pat. No. 4,587,189, the disclosure of which is totally incorporated herein by reference and which BZP is doped with a substituted or unsubstituted bis(benzimidazo) perinone, illustrated in Formula 1, and/or a bis(alkylimido)

perylene pigment of the type illustrated in Formula 2 and, as a top layer, a charge transport layer.

Formula 1

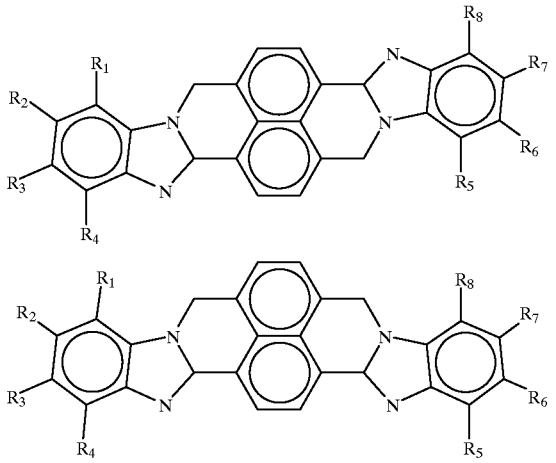

wherein $R_1$ to $R_8$ can be the same or different inclusive of hydrogen, alkyl (for example methyl, ethyl, tert-butyl, octyl) containing from 1 to about 25 carbons, alkoxy containing from 1 to about 25 carbon atoms, such as methoxy, isopropoxy, aryloxy with, for example, from about 7 to about 30 carbon atoms, such as phenoxy, halogen (i.e., fluoro, chloro, bromo, or iodo), nitro, amino, mono- or di-alkylamino, such as $CH_3NH$, $(CH_3)_2N$, mono- or di-arylamino, such as phenylamino or diphenylamino, cyano, thiol (i.e. SH), alkylthio, such as, for example, methylthio or n-butylthio, or arylthio, such as phenylthio.

Formula 2

(a)

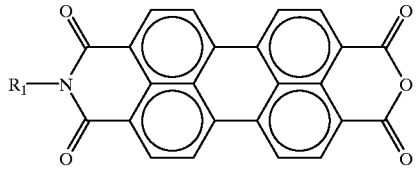

(b)

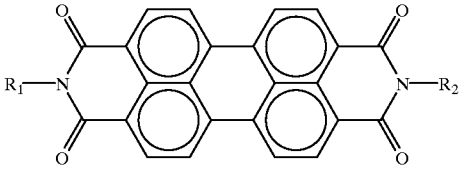

(a) a monoalkylimidoperylene monoanhydride, (b) a bis (alkylimido)perylene wherein $R_1$ and $R_2$ can be, for example, the same or different linear or branched alkyl groups containing from 1 to about 18 carbon atoms, such as methyl, ethyl, isopropyl, n-pentyl, neopentyl and the like, or other suitable groups.

Of value with respect to the present invention is the doping of the BZP photogenerating pigment with a bis (benzimidazo)perinone or a mixture of isomers of a substituted bis(benzimidazo)perinone, such as the isomeric mixture of cis- and trans bis(3-methylbenzimidazo)perinones, illustrated by Formula 1, a mono-or bis-(alkylimido) perylene such as mono- (Formula 1a with R=n-pentyl) or bis-(n-pentylimido)perylene (Formula 1b with $R_1$=$R_2$=n-pentyl), the amounts of each component in the pigment mixture being, for example, from about 60 to about 98 weight percent of BZP and about 2 to about 40 percent of the dopant and preferably from about 90 to 95 percent of BZP, and about 5 to 10 percent of dopant and wherein the total percentage of the mixture is about 100 percent. The dopant of the perinone, mixtures of isomers thereof, the perylene, mixture of isomers thereof, can, more specifically, each be present in an amount of 1, 2, 5, 10, 20 or 50 weight percent. When mixtures, such as isomers are present, each isomer is selected in a suitable amount to enable 100 weight percent total, for example from about 1 to about 99 weight percent of one isomer, and from about 99 to about 1 weight percent of a second isomer, about including all weight percentages in between 1 and 99. Specific examples of dopants, including isomer mixtures thereof, are bis(dichlorobenzimidazo) perinone, preferably sublimed; bis(4-chlorobenzimidazo) perinone; bis(methyl benzimidazo)perinone, preferably sublimed; bis(dimethyl benzimidazo)perinone; butylimido perylene monoanhydride; mixed (n-pentylimido)perylene monoanhydride; bis(phenethylimido)perylene; bis(3-chlorobenzylimido)perylene, and bis(3-chloro-4-fluorobenzylimido)perylene.

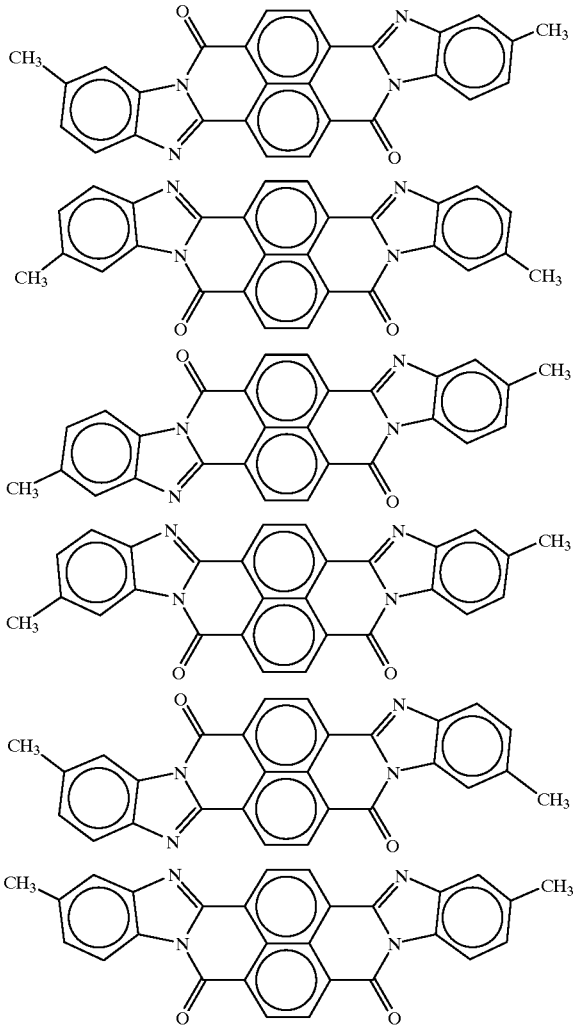

Isomers of bis(4-methylbenzimidazo)perinones obtained from the condensation of 4-methyl-1,2-diaminobenzene with naphthalene-1,4,5,8-tetracarboxylic acid dianhydride.

Examples of bis(arylimidazo)perinones, such as the unsubstituted bis(benzimidazo)perinone isomers (Formula 1, with $R_1=R_2=R_3=R_4=R_5=R_6=R_7=R_8=H$), also known, respectively, as Pigment Red 194 (cis-isomer) and Pigment Orange 43 (trans-isomer), are commercially available. Otherwise, they can be readily prepared, as described in the textbook *"Industrial Organic Pigments"* by W. Herbst and K. Hunger (published by VCH, 1997), reference, for example, page 486, the disclosure of which is totally incorporated herein by reference, by, for example, condensation of an ortho-phenylene diamine with 1,4,5,8-naphthalene tetracarboxylic acid dianhydride. When an unsymmetrically substituted ortho-phenylene diamine is used, a mixture of up to six possible isomers are obtained. For example, the possible isomers that could result from condensation of 4-methyl-1,2-diaminobenzene are illustrated in Formula 1. Certain bis(alkylimido)perylenes are also commercially available, such as the bis(methylimide) (Formula 2 with $R_1=R_2=CH_3$), which is known as Pigment Red 179. They can also be readily prepared by condensation of alkyl amines with 3,4,9,10-perylene tetracarboxylic acid dianhydride, according to methods discussed in the aforementioned text by Herbst and Hunger, the disclosure of which is totally incorporated herein by reference, reference for example page 477.

The two-tier imaging member can also be selected for color xerographic printing processes as described, for example, in U.S. Pat. No. 5,756,245, the disclosure of which is totally incorporated herein by reference, wherein when selectively imaged with two laser lights of different wavelengths, such two-tiered members enable xerographic printing of three colors in a single pass process. After being charged to about −800 volts, the imaging member is selectively discharged by exposure to a suitable type of light. The top tier comprising BZP and top transport layer is discharged by about 680 nanometers of radiation. The bottom tier is discharged by about 830 nanometers of radiation. Thus, four resultant areas on the imaging member are created after passing an imaging station wherein:

(a) the unexposed area retains the original surface potential, about −800 volts, (b) the area exposed with about 680 nanometers, which is discharged to about one-half of the original surface voltage, about −400 volts, (c) the area exposed with about 830 nanometers, which is also discharged to about one-half of the original surface voltage, that is about −400 volts; and (d) the area exposed with both about 680 and about 830 nanometers which is fully discharged to about 0 (zero) volts.

While three potential levels are present on the imaging member at this stage immediately after exposure, there will be four distinctively different areas on the surface of the imaging member after xerographic development as indicated herein. After toning the area (a) with charge area development (CAD), the surface potential of (a) is changed to −400 volts by a positively charged black toner. Then, applying discharge area development step (DAD) and toning area (b), the surface potential is changed to about −400 volts by negatively charged toners. As a result, the four areas are at equal potential (−400 volts) at this stage. By exposing the imaging member with a broad band exposure 500 to 700 nanometers, area (c) is further discharged to 0 volts as the BZP layer is photoactive in this wavelength range. Area (a) is not discharged as the toners on it block this radiation. Area (b) is not discharged because the top BZP generator layer completely absorbs the radiation. By applying a (DAD) step, area (c) is now toned with another color toner. Area (b) remains untoned. Therefore, three color toners can be deposited in a single pass.

Embodiments of the present invention include a method of imaging which comprises generating an electrostatic latent image on the imaging member comprised in the following order of a supporting substrate, a doped photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, and containing a dopant comprised of a bis(benzimidazo)perinone, and/or a bis(alkylimido)perylene, as illustrated, for example, by Formulae 1 and 2, and as a top layer a charge transport layer; developing the latent image; and transferring the developed electrostatic image to a suitable substrate; and wherein the imaging member is exposed to light of a wavelength of from about 550 to about 950 nanometers; and a method of imaging which comprises generating an electrostatic latent image on an imaging member comprised of a supporting substrate, a hydroxygallium phthalocyanine photogenerator layer, a first charge transport layer, a polyester barrier layer, a photogenerator layer comprised of bis(methylbenzimidazo)perinone, (n-pentylimido)perylene, or mixtures thereof, bisbenzimidazo(2,1-a-1',2'-b)anthra(2,1,9-def:6,5,10-d'e'f')diisoquinoline -6,11-dione and bisbenzimidazo(2,1-a:2',1'-a)anthra(2,1,9-def:6,5,10-d'e'f')diisoquinoline-10,21-dione, and as a top layer a second charge transport layer, developing the latent image; and transferring the developed electrostatic image to a suitable substrate; and wherein the imaging member is simultaneously exposed to light of a wavelength of from about 500 to about 800 nanometers; and a wavelength of from about 550 to about 950 nanometers.

With further respect to the present invention for the two tier member is the selection of a suitable barrier layer, examples of which include polyesters, such as VITAL®, PE100 and PE200 available from Goodyear Chemicals, and especially MOR-ESTER 49,000® available from Norton International. The barrier layer can be coated onto the first charge transport layer from a tetrahydrofuran and/or dichloromethane solution with a thickness ranging from 0.1 to 3.0 microns. The main function of the barrier layer is to prevent the diffusion of transport molecules from the first transport layer into the top BZP layer, which otherwise results in charge leakage and cross talk. Cross talk refers, for example, to the undesirable discharge of one generator layer when the second generator layer is exposed to laser light. For example, if a two-tier imaging member is charged to −800V, ideally a 400V (50 percent) discharge with no cross talk is expected from each tier when they are sequentially exposed to light. However, in a non-ideal situation, the first tier might be photodischarged to, for example, −400V followed by a voltage drop of 200V, due to charge leakage, followed by the photodischarge of the second tier to zero volt. In this situation, the imaging member can possess a 25 percent cross talk. Cross talks of, for example, less than 3 percent are acceptable and will not, it is believed, adversely affect developability. The incorporation of the barrier layer significantly improves the discharge split of the two-tier imaging member and reduced cross talk from about 17 to 21 percent to about 2 to 4 percent. Also, in embodiments there may be selected, it is believed, in place of the barrier layer known blocking layer components.

The hydroxygallium photogenerating layer, which is preferably comprised of hydroxygallium phthalocyanine Type V, is in embodiments comprised of, for example, about 50 weight percent of the Type V crystal modifications and about 50 weight percent of a resin binder like polystyrene/polyvinylpyridine; and the BZP layer is in embodiments comprised of, for example, about 80 weight percent of BZP dispersed in a resin binder like polyvinylbutyral. The photoconductive imaging member with two photogenerating layers and two charge transport layers can be prepared by a number of methods, such as the coating of the layers, and more specifically as illustrated herein. Thus, the photoresponsive imaging members of the present invention can in embodiments be prepared by a number of known methods, the process parameters and the order of coating of the layers being dependent, for example, on the member desired. The photogenerating and charge transport layers of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from 40 to about 200° C. for from 10 minutes to several hours under stationary conditions or in an air flow. The coating can be accomplished to provide a final coating thickness of from about 0.01 to about 30 microns after drying. The fabrication conditions for a given photoconductive layer can be tailored to achieve optimum performance and cost in the final members.

Imaging members of the present invention are useful in various electrostatographic imaging and printing systems, particularly those conventionally known as xerographic processes. Specifically, the two tier imaging members of the present invention are useful in xerographic imaging processes wherein the Type V hydroxygallium phthalocyanine pigment absorbs light of a wavelength of from about 550 to about 950 nanometers, and preferably from about 700 to about 850 nanometers; and wherein the second BZP layer absorbs light of a wavelength of from about 500 to about 800 nanometers, and preferably from about 600 to about 750 nanometers. In these processes, electrostatic latent images are initially formed on the imaging member followed by development, and thereafter, transferring the image to a suitable substrate. Moreover, the imaging members of the present invention can be selected for electronic printing processes with gallium arsenide diode lasers, light emitting diode (LED) arrays which typically function at wavelengths of from 660 to about 830 nanometers.

In embodiments, the photoconductive imaging member is comprised in sequence of a conductive supporting substrate, a doped BZP photogenerating layer thereover, and transport layer, can be initially charged with red light, about 670 nanometers, IR, about 830 nanometers, and subsequently charged with red light at 670 nanometers, and IR at 830 nanometers, and which subsequent charges are applied to a portion of the member not initially charged.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

Generally, the thickness of one or each of the photogenerator layers for the two tier members depends on a number of factors, including the thicknesses of the other layers and the amount of photogenerator material. Accordingly, the photogenerating layer can be of a thickness of, for example, from about 0.05 micron to about 10 microns, and more specifically, from about 0.25 micron to about 1 micron when, for example, the photogenerator composition is present in an amount of from about 80 to about 100 percent, the amount of embodiments being dependent primarily upon factors, such as photosensitivity, electrical properties and mechanical considerations. The photogenerating layer binder resin, present in various suitable amounts, for example from about 1 to about 20, and more specifically, from about 1 to about 10 weight percent, may be selected from a number of polymers such as poly(vinyl butyral), poly(vinyl carbazole), polyesters, polycarbonates, poly (vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is, for example, from about 0.01 to about 30 microns and preferably from about 0.1 to about 15 microns after being dried at, for example, about 40° C. to about 150° C. for about 5 to about 90 minutes.

Illustrative examples of polymeric binder materials that can be selected for the photogenerator pigments are as indicated herein, and include those polymers as disclosed in U.S. Pat. No. 3,121,006, the disclosure of which is totally incorporated herein by reference.

As adhesives usually in contact with the supporting substrate, and/or barrier layer there can be selected various known substances inclusive of polyesters, such as polyester 46,000 available from E. I. DuPont, polyamides, poly(vinyl butyral), poly(vinyl alcohol), polyurethane and polyacrylonitrile. This layer is of a thickness of, for example, from about 0.001 micron to about 1 micron. Optionally, this layer may contain effective suitable amounts, for example from about 1 to about 10 weight percent, conductive and non-conductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally are of a thickness of from about 5 microns to about 75 microns, and preferably of a thickness of from about 10 microns to about 40 microns, include molecules of the following formula

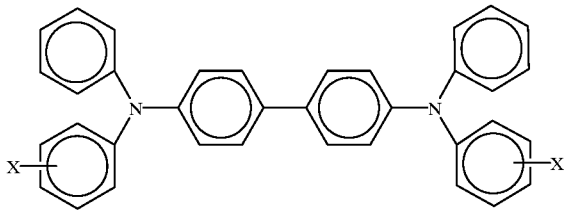

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder material for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material. Charge transport, especially hole transports other than those specifically disclosed herein may also be selected.

Included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as colorant, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the above sequence with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. A Comparative Example is also provided.

SYNTHESIS EXAMPLE 1

Bis(4-methylbenzimidazo)perinone-Mixed Isomers

A suspension of naphthalene-1,4,5,8-tetracarboxylic acid dianhydride (5.36 grams, 0.02 mole), 3,4-diaminotoluene (3.7 grams, 0.030 mole) and zinc acetate dihydrate (1.1 grams, 0.006 mole) in 150 milliliter of N-methylpyrollidinone (NMP) was stirred and heated at reflux (ca. 202° C.) for 4 hours. The resultant dark brown suspension was cooled to about 50° C., then was filtered. The solid was washed with 3×50 milliliter portions of N,N-dimethylformamide (NMP) then with 3×23 milliliter portions of methanol. Drying at 60° C. gave 8.1 grams (92 percent yield) of dark brown solid. A proton magnetic resonance spectrum of the product indicated that a mixture of isomers was present. No attempt was made to separate or further analyze this material. The mixture was used, as-synthesized, for the doping experiments.

SYNTHESIS EXAMPLE 2

Bis(n-pentylimido)perylene

A mixture of perylene-3,4,9,10-tetracarboxylic acid dianhydride (7.84 grams, 0.10 mole) and n-pentylamine (8.72 grams, 11.6 milliliters, 0.10 mole) in 300 milliliters of NMP (n-methylpyrolidone) was stirred and heated to reflux for 30 minutes. The resultant solution was cooled with stirring to 120° C., at which temperature crystals were present in the reaction mixture. The hot suspension was filtered and the solid was washed with 3×50 milliliter portions of DMF (dimethyl formamide) at 120° C. followed by 50 milliliters of cold DMF and 3×50 milliliter portions of methanol. The product was dried at 60° C. to provide 8.7 grams (82 percent yield) of shiny black crystals. Elemental analysis of the product was C, 76.76; , H, 5.66; , N, 5.44, compared to theoretical for $C_{34}H_{30}N_2O$ for C, 76.96; , H, 5.70; , N, 5.28.

SYNTHESIS EXAMPLE 3

Monopentylimidoperylene

A mixture of perylene-3,4,9,10-tetracarboxylic acid dianhydride (78.4 grams, 0.20 mole), potassium hydroxide (85 percent, 13.2 grams, 0.20 mole) and n-pentylamine (52.3 grams, 69.5 milliliters, 0.60 mole) in 2.5 liter of water was stirred at room temperature for 2½ hours. The mixture was then heated to about 90° C. and was held at that temperature for ½ hour. Concentrated hydrochloric acid was slowly added and the resultant thick red suspension was stirred at 90° C. for 15 minutes, cooled to 60° C. and then filtered. The solid resulting was washed with 3×1,000 milliliter of water. The resultant crude product, a mixture of the above product together with starting dianhydride and bis(n-pentylimide) was purified as follows.

The crude product was stirred in 2 liters of water and was treated with 39.6 grams (0.6 mole) of potassium hydroxide. After 1 hour, 20 grams of Celite filter aid were added and the suspension containing undissolved bis(n-pentylimide) was filtered and the solid was washed with 3×100 milliliters of water. The filtrate was treated with 200 grams (ca. 6 percent solution) of potassium chloride and was stirred overnight, about 18 hours. The resultant suspension containing salted-out monoimide dicarboxylate dipotassium salt was filtered and the salt was washed with 5 percent aqueous potassium chloride (6×200 milliliter portions) until the wash was colorless. The resulting wet cake was the stirred in 2 liters of water and the mixture was heated to 90° C. Treatment with 55.5 milliliter (ca. 1 mole) of concentrated sulfuric, acid followed by heating at 90° C. provided the mono(n-pentylimide)monoanhydride. The suspension was filtered and the solid was washed with water until the wash water pH was 6. The product was freeze dried to provide 63 grams (68 percent yield) of the above product monopentyl imidoperylene as a fine powder.

SYNTHESIS EXAMPLE 4

Monopentylimidoperylene Monoanhydride-Mixed Isomers

The above procedure of Example 3 was repeated using a commercially available bulk source of amylamine of a mixture of n-pentylamine and the isomeric 2-methylbutylamine in roughly a 55:45 molar ratio, respectively. The resultant monopentylimide was determined by nuclear magnetic resonance spectroscopy to be an isomeric mixture of about 55 percent of the n-pentyl and 45 percent of the 2-methylbutyl monoimide. This mixture was used, as-synthesized, as a dopant for BZP.

EXAMPLE I

Alkoxy-bridged Gallium Phthalocyanine Dimer Synthesis Using Gallium Methoxide Obtained From Gallium Chloride and Sodium Methoxide In Situ To a 1 liter round bottomed flask were added 25 grams of $GaCl^3$ and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 400° C. Subsequently, 250 milliliters of ethylene glycol and 72.8 grams of o-phthalodinitrile were added. The methanol and toluene were quickly distilled off over 30 minutes while heating from 70° C. to 135° C., and then the phthalocyanine synthesis was performed by heating at 195° C. for 4.5 hours. The alkoxy-bridged gallium phthalocyanine dimer was isolated by filtration at 120° C. The product was then washed with 400 milliliters DMF at 100° C. for 1 hour and filtered. The product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl) ethane, was isolated as a dark blue solid in 77 percent yield. The dimer product was characterized by elemental analysis, infrared spectroscopy, $^1H$ NMR spectroscopy and X-ray powder diffraction. Elemental analysis showed the presence of only 0.10 percent of chlorine. Infrared spectroscopy: major peaks at 573, 611, 636, 731, 756, 775, 874, 897, 962, 999, 1069, 1088, 1125, 1165, 1289, 1337, 1424, 1466, 1503, 1611, 2569, 2607, 2648, 2864, 2950, and 3045 $cm^{-1}$; $^1H$ NMR spectroscopy (TFA-d/$CDCl_3$ solution, 1:1 v/v, tetramethylsilane reference): peaks at 4.00 (4H), 8.54 (16H), and 9.62 (16H); X-ray powder diffraction pattern: peaks at Bragg angles (2 theta±0.2°) of 6.7, 8.9, 12.8, 13.9, 15.7, 16.6, 21.2, 25.3, 25.9, and 28.3 with the highest peak at 6.7 degrees.

EXAMPLE II

Hydrolysis of Alkoxy-bridged Gallium Phthalocyanine to Hydroxygallium Phthalocyanine (Type I)

The hydrolysis of alkoxy-bridged gallium phthalocyanine synthesized in Example I to hydroxygallium phthalocyanine was performed as follows. Sulfuric acid (94 to 96 percent, 125 grams) was heated to 40° C. in a 125 milliliter Erlenmeyer flask, and then 5 grams of the chlorogallium phthalocyanine were added. Addition of the solid was completed in approximately 15 minutes, during which time the temperature of the solution increased to about 48° C. The acid solution was then stirred for 2 hours at 40° C., after which it was added in a dropwise fashion to a mixture comprised of concentrated (30 percent) ammonium hydroxide (265 milliliters) and deionized water (435 milliliters), which had been cooled to a temperature below 5° C. The addition of the dissolved phthalocyanine was completed in approximately 30 minutes, during which time the temperature of the solution increased to about 40° C. The reprecipitated phthalocyanine was then removed from the cooling bath and allowed to stir at room temperature for 1 hour. The resulting phthalocyanine was then filtered through a porcelain funnel fitted with a Whatman 934-AH grade glass fiber filter. The resulting blue solid was redispersed in fresh deionized water by stirring at room temperature for 1 hour and filtered as before. This process was repeated at least three times until the conductivity of the filtrate was <20 $\mu$S. The filter cake was oven dried overnight at 50° C. to give 4.75 grams (95 percent) of Type I HOGaPc, identified by infrared spectroscopy and X-ray powder diffraction, XRPD. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in X-ray crystallographic measurements. I (counts) represents the intensity of the diffraction as a function of Bragg angle as measured with a proportional counter. Infrared spectroscopy: major peaks at 507, 573, 629, 729, 756, 772, 874, 898, 956, 984, 1092, 1121, 1165, 1188, 1290, 1339, 1424, 1468, 1503, 1588, 1611, 1757, 1835, 1951, 2099, 2207, 2280, 2384, 2425, 2570, 2608, 2652, 2780, 2819, 2853, 2907, 2951, 3049 and 3479 (broad) $cm^{-1}$; X-ray diffraction pattern: peaks at Bragg angles of 6.8, 13.0, 16.5, 21.0, 26.3 and 29.5 with the highest peak at 6.8 degrees (2 theta +/−0.2°).

EXAMPLE III

Conversion of Type I Hydroxygallium Phthalocyanine to Type V

The Type I hydroxygallium phthalocyanine pigment obtained in Example II was converted to Type V HOGaPc as follows. The Type I hydroxygallium phthalocyanine pigment (3 grams) was added to 25 milliliters of N,N-dimethylformamide in a 60 milliliter glass bottle containing 60 grams of glass beads (0.25 inch in diameter). The bottle was sealed and placed on a ball mill overnight (18 hours). The solid was isolated by filtration through a porcelain funnel fitted with a Whatman GF/F grade glass fiber filter, and washed in the filter using several 25 milliliter portions of acetone. The filtered wet cake was oven dried overnight at 50° C. to provide 2.8 grams of Type V HOGaPc which was identified by infrared spectroscopy and X-ray powder diffraction. Infrared spectroscopy: major peaks at 507, 571, 631, 733, 756, 773, 897, 965, 1067, 1084, 1121, 1146, 1165, 1291, 1337, 1425, 1468, 1503, 1588, 1609, 1757, 1848, 1925, 2099, 2205, 2276, 2384, 2425, 2572, 2613, 2653, 2780, 2861, 2909, 2956, 3057 and 3499 (broad) $cm^{-1}$; X-ray diffraction pattern: peaks at Bragg angles of 7.4, 9.8, 12.4, 12.9, 16.2, 18.4, 21.9, 23.9, 25.0 and 28.1 with the highest peak at 7.4 degrees (2 theta +/−0.2°).

EXAMPLE IV

Fabrication and Testing of Imaging Members Containing Mixed-Pigments

A BZP dispersion was prepared by milling 0.40 gram of BZP pigment mixture, 0.1 gram of polycarbonate, and 8 grams of tetrahydrofuran in a 30 milliliter bottle containing 70 grams of ⅛ inch stainless steel balls. The milling time was for 5 days. The BZP pigment mixture contained from about 0.375 to about 0.4 gram BZP doped with from 0 to 0.025 gram bis(methylbenzimidazo)perinone or doped with from 0 to 0.025 gram n(penthylimido)perylene. The BZP dispersion was diluted and coated with a 2 mil applicator and the coated device was dried at from 100° C. to 135° C. for 20 minutes. The optical density of the charge generator layer varied from 1.0 to 2.12 depending on dopant concentration. Finally, a hole transport layer comprised of 6.34 grams of N,N'-diphenyl-N,N-bis(3-methyl phenyl) -1,1'-biphenyl4,4'-diamine, and 6.34 grams of polycarbonate dissolved in 55 milliliters of dichloromethane. The solution was coated onto the above BZP generator layer using a 10 mil film applicator. The charge transporting layer thus obtained was dried at from 100° C. to 135° C. for 20 minutes to provide a final thickness of about 25 to 28 microns.

The xerographic electrical properties of the imaging member were determined by known means, including as indicated herein electrostatically charging the surfaces thereof with a corona discharge source until the surface potentials, as measured by a capacitively coupled probe attached to an electrometer, attained an initial value $V_0$ of about −800 volts. After resting for 0.5 second in the dark, the charged members attained a surface potential of $V_{ddp}$, dark development potential. Imaging members were then exposed to light from a filtered Xenon lamp with a BO 150 watt bulb, thereby inducing a photo discharge which resulted in a reduction of surface potential to a $V_{bg}$ value, background potential. The wavelength of the incident light was $\lambda$=680 nanometers, and the energy of the incident light varied from E=0 to 30 ergs/cm$^2$. The imaging member electrical properties, such as $V_{ddp}$, $E_{1/2}$, $E_{7/8}$, dark decay, $V_{bg}$ and photo sensitivity S, were determined and then normalized to the optical density and to the thickness of the imaging member.

The results of xerographic evaluation showed that by doping the BZP pigment with bis(methylbenzimidazo) perinone, the $E_{1/2}$ and the photosensitivity of the imaging member were enhanced by about 12 percent and 22 percent, respectively, while the dark decay potential remained at acceptably low levels. The concentration of bis (methylbenzimidazo)perinone was varied from 1 to 50 percent and a higher sensitivity was attained at about 5 to 15 percent dopant level. Identical improvements were observed when the BZP pigment was doped with n(penthylimido) perylene, in which case $E_{1/2}$ and S were enhanced by about 10 and 15 percent, respectively. However, dark decay potential seemed to increase with increasing n(penthylimido) perylene concentration reaching about 35 volts at 20 percent dopant level. Therefore, a preferred concentration of n(penthylimido) perylene is believed to be less than about 20 percent.

EXAMPLE V

Cycling Stability of Imaging Members Containing Mixed Pigments

The cycling stability of imaging members (p/r's), as prepared in Example IV, were determined using a motionless scanner. In a motionless scanner, xerographic properties of an imaging member were measured by repeatedly charging the member to a constant potential and discharging by exposing the member to a white light with constant intensity. In this Example, cycling tests were performed on the perylene-doped, perinone-doped and undoped (control) BZP p/r devices. The imaging members were charged to from about 800 to about 1,000 volts, discharged with a white light with $\lambda$=400 to 700 nanometers and intensity of 20 ergs/cm$^2$ and xerographic properties, such as changes in dark development potential ($\Delta V_{ddp}$), background potential ($\Delta V_{bg}$), and residual voltage ($\Delta V_r$), were measured. The following table demonstrates the stability of these p/r's after 20,000 cycles.

| Imaging Member | Change In Xerographic Properties After 20,000 Cycles | | |
|---|---|---|---|
| | $\Delta V_{ddp}$ | $\Delta V_{bg}$ | $\Delta V_r$ |
| Undoped BZP (Control) | 12 | 12 | 5 |
| BZP Doped With Bis(Methylbenzimidazo)Perinone | 10 | 12 | 11 |
| BZP Doped With (N-Pentylimido)Perylene | 28 | 26 | 11 |

The doping process with the invention pigments mentioned above, such as the perinone, did not change the cycling stability of the imaging member.

Other modifications of the present invention may occur to those of ordinary skill in the art subsequent to a review of the present application, and these modifications, including equivalents thereof, are intended to be included within the scope of the present invention.

What is claimed is:

1. A photoconductive imaging member comprised of a photogenerator layer comprised of bis(methylbenzimidazo) perinone, or (n-pentylimido)perylene, and bisbenzimidazo (2,1-a-1',2'-b)anthra(2,1,9-def:6,5,10-d'e'f')diisoquinoline-6, 11-dione and bisbenzimidazo(2,1-a:2',1'-a)anthra(2,1,9-def:6,5,10-d'e'f')diisoquinoline-10,21-dione, and a charge transport layer.

2. A photoconductive imaging member comprised of a supporting substrate, photogenerator layer comprised of a mixture of bisbenzimidazo(2,1-a-1',2'-b)anthra(2,1,9-def:6, 5,10-d'e'f')diisoquinoline-6,11-dione and bisbenzimidazo(2, 1-a:2',1'-a)anthra(2,1,9-def:6,5,10-d'e'f')diisoquinoline-10, 21-dione, and a charge transport layer, and wherein said photogenerating layer further contains bis (methylbenzimidazo)perinone or (n-pentylimido)perylene.

3. A photoconductive imaging member in accordance with claim 2 wherein said bis(methylbenzimidazo)perinone, or said (n-pentylimido)perylene is present in an amount of from about 1 to about 50 weight percent.

4. A photoconductive imaging member in accordance with claim 2 wherein said bis(methylbenzimidazo)perinone, or said (n-pentylimido)perylene is present in an amount of from about 1 to about 25 weight percent.

5. A photoconductive imaging member in accordance with claim 2 wherein a mixture is present containing from about 75 to about 100 weight percent of bis (methylbenzimidazo)perinone, and from about zero (0) to about 25 weight percent of (n-pentylimido)perylene, and wherein the total of said two components in the mixture is about 100 percent.

6. A photoconductive imaging member in accordance with claim 2 wherein about 1 weight percent of (n-pentylimido)perylenes is present.

7. A photoconductive imaging member in accordance with claim 2 wherein a mixture of isomers of (n-pentylimido)perylenes or bismethyl benzimidazo) perinone is present.

8. A photoconductive imaging member in accordance with claim 2 wherein the photogenerator layer is situated between the substrate and the charge transport layer.

9. A photoconductive imaging member in accordance with claim 2 wherein the supporting substrate is comprised of a conductive substrate comprised of a metal.

10. A photoconductive imaging member in accordance with claim 2 wherein the substrate is a conductive substrate of aluminum, aluminized polyethylene terephthalate (MYLAR®), or titanized polyethyl terephthalate wherein said MYLAR® is of the formula

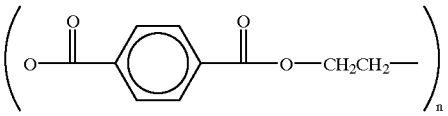

wherein n represents the number of segments.

11. A photoconductive imaging member in accordance with claim 2 wherein the photogenerator layer has a thickness of from about 0.05 to about 10 microns.

12. A photoconductive imaging member in accordance with claim 2 wherein the transport layer has a thickness of from about 5 to about 75 microns.

13. A photoconductive imaging member in accordance with claim 2 wherein the photogenerating layer is dispersed in a resinous binder in an amount of from about 5 percent by weight to about 95 percent by weight.

14. A photoconductive imaging member in accordance with claim 13 wherein the resinous binder is selected from the group consisting of polyesters, polyvinyl butyrals, polycarbonates, polystyrene-b-polyvinyl pyridine, and polyvinyl formals.

15. A photoconductive imaging member in accordance with claim 2 wherein said charge transport layers comprise aryl amine molecules.

16. A photoconductive imaging member in accordance with claim 15 wherein the aryl amines are of the formula

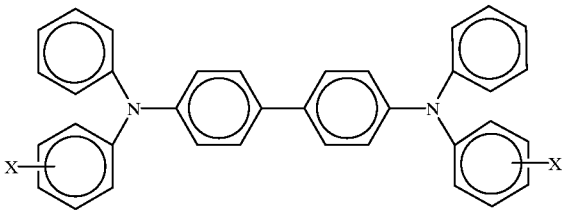

wherein X is selected from the group consisting of alkyl and halogen.

17. A photoconductive imaging member in accordance with claim 16 wherein alkyl contains from about 1 to about 10 carbon atoms.

18. A photoconductive imaging member in accordance with claim 16 wherein the aryl amines are molecules comprised of N,N'-diphenyl-N,N-bis(3-methyl phenyl)-1,1'-biphenyl-4,4'-diamine.

19. A photoconductive imaging member in accordance with claim 1 further containing on the substrate a barrier layer of a thickness of from about 0.1 to about 3 microns.

20. A photoconductive imaging member in accordance with claim 19 wherein the barrier layer is a polyester.

21. A method of imaging which comprises generating an electrostatic latent image on the imaging member of claim 1, developing the latent image, and optionally transferring the developed electrostatic image to a suitable substrate.

22. A method in accordance with claim 21 wherein said member is exposed to wavelengths of from about 680 to about 830 nanometers, respectively.

23. A two-tier photoconductive imaging member comprised in the following sequence of a supporting substrate, a first hydroxygallium phthalocyanine photogenerator layer which absorbs light of a wavelength of from about 550 to about 950 nanometers, a first charge transport layer, a barrier layer, a second photogenerator layer comprised of a mixture of bis(methylbenzimidazo)perinone or (n-pentylimido) perylene, and bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione (BZP), which absorbs light of a wavelength of from about 500 to about 800 nanometers, and thereover a second charge transport layer.

24. A photoconductive imaging member in accordance with claim 1 wherein a mixture of said bis (alkylbenzimidazo)perinone and said (alkylimido)perylene is present.

25. A process for forming an imaging member which comprises adding to a photoconductive imaging member containing (BZP) bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and bis(alkylbenzimidazo) perinone, (alkylimido)perylene, or mixtures of (alkylimido) perylenes.

26. A process in accordance with claim 25 wherein said perinone is bis(methyl benzimidazo)perinone and said alkyl perylene is (n-pentylimido)perylene.

27. An imaging or printing apparatus containing the imaging member of claim 1.

28. A photoconductive imaging member comprised of a photogenerator layer comprised of bis(alkylbenzimidazo) perinone, bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, and a charge transport layer.

29. A photoconductive imaging member comprised of a photogenerator layer comprised of (alkylimido)perylene, bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f')diisoquinoline-10,21-dione, and a charge transport layer.

30. A photoconductive imaging member in accordance with claim 28 wherein said perinone is a dopant.

31. A photoconductive imaging member in accordance with claim 29 wherein said perylene is a dopant.

32. A photoconductive imaging member in accordance with claim 30 wherein said dopant is present in an amount of from about 1 to about 7 weight percent.

33. A photoconductive imaging member in accordance with claim 31 wherein said dopant is present in an amount of from about 1 to about 7 weight percent.

34. A photoconductive imaging member in accordance with claim 29 wherein said perylene is comprised of a mixture of perylenes.

35. A photoconductive imaging member in accordance with claim 28 wherein said perylene is of the formula, or mixtures thereof (a)
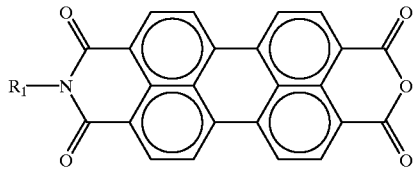
(b)
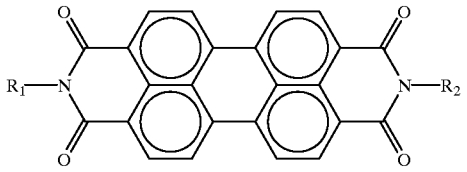
wherein $R_1$ to $R_8$ are independently hydrogen, alkyl, alkoxy, aryl, or aryloxy.
36. A photoconductive imaging member in accordance with claim 29 wherein said perinone is of the formula, or mixtures thereof
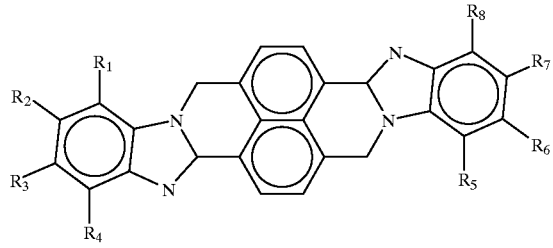
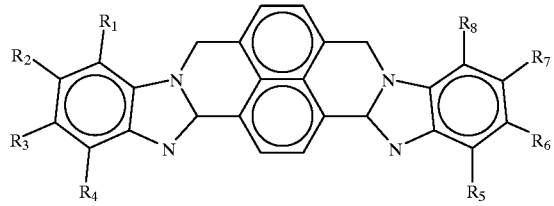
wherein $R_1$ and $R_2$ are independently alkyl.
* * * * *